US010253612B2

(12) United States Patent
Dashevskiy et al.

(10) Patent No.: US 10,253,612 B2
(45) Date of Patent: Apr. 9, 2019

(54) DRILLING CONTROL SYSTEM AND METHOD

(75) Inventors: Dmitriy Dashevskiy, Nienhagen (DE); Jens Rudat, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1329 days.

(21) Appl. No.: 13/282,079

(22) Filed: Oct. 26, 2011

(65) Prior Publication Data

US 2012/0109382 A1 May 3, 2012

Related U.S. Application Data

(60) Provisional application No. 61/407,053, filed on Oct. 27, 2010.

(51) Int. Cl.
*E21B 44/00* (2006.01)

(52) U.S. Cl.
CPC ..... *E21B 44/00* (2013.01)

(58) Field of Classification Search
CPC .. E21B 44/00; E21B 47/12; E21B 2041/0028; E21B 7/068; E21B 44/005; E21B 47/00; E21B 47/18
USPC ..... 700/275
See application file for complete search history.

(56) References Cited

U.S. PATENT DOCUMENTS 5,160,925 A * 11/1992 Dailey et al. ..... 340/853.3
5,842,149 A 11/1998 Harrell et al.
6,021,377 A * 2/2000 Dubinsky et al. ..... 702/9
8,256,534 B2 * 9/2012 Byreddy et al. ..... 175/57
2004/0196038 A1 10/2004 Kruspe et al.
2006/0212224 A1 9/2006 Jogi et al.
2009/0090555 A1 4/2009 Boone et al.
2009/0115625 A1 5/2009 Young
2010/0108384 A1 5/2010 Byreddy et al.
2010/0258352 A1 * 10/2010 Aldraihem ..... E21B 17/00 175/57
2011/0245980 A1 * 10/2011 Nessjoen et al. ..... 700/280
2012/0130693 A1 * 5/2012 Ertas ..... E21B 44/00 703/2

OTHER PUBLICATIONS

International Search Report and Written Opinion dated Jun. 22, 2012 for Application No. PCT/US2011/058102.
A. Jan, et al.; "The New Drilling control and Monitoring System"; Acta Montanistica Slovaca; vol. 9, issue 3; p. 145-151; 2004.
G. L. Cavanough, et al.; "A Self-Optimizing Control for Hard Rock Percussive Drilling"; IEEE/ASME Transactions on Mechatronics, vol. 13, No. 2; p. 153-157; Apr. 2008.
GB Office Action for Application No. 1307274.9, dated Jun. 25, 2018, 4 pages.

* cited by examiner

*Primary Examiner* — Sean Shechtman
(74) *Attorney, Agent, or Firm* — Cantor Colburn LLP

(57) ABSTRACT

A system includes a control unit including a model of the system that includes model parameters and operational conditions. The system also includes an assembly that includes one or more sensor modules and a second processor, the second processor including definitions of the model parameters and configured to determine the model parameters based on information received from the one or more sensors. The system also includes a communication medium communicatively coupling the control unit and the assembly.

14 Claims, 3 Drawing Sheets

1
14
18
13
12
24
9
16
15
31
21
19
17
20
22
10
11

DRILLING CONTROL SYSTEM AND METHOD

This application claims priority under 35 U.S.C. 119 to U.S. Provisional Patent Application Ser. No. 61/407,053, filed Oct. 27, 2010 and entitled "DRILLING CONTROL SYSTEM AND METHOD."

BACKGROUND

Exploration and production of hydrocarbons generally requires that a borehole be drilled deep into the earth. The borehole provides access to a geologic formation that may contain a reservoir of oil or gas.

Drilling operations require many resources such as a drilling rig, a drilling crew, and support services. These resources can be very expensive. In addition, the expense can be even much higher if the drilling operations are conducted offshore. Thus, there is an incentive to contain expenses by drilling the borehole efficiently.

Efficiency can be measured in different ways. In one way, efficiency is measured by how fast the borehole can be drilled. Drilling the borehole too fast, though, can lead to problems. If drilling the borehole at a high rate-of-penetration results in a high probability of damaging equipment, then resources may be wasted in downtime and repairs. In addition, attempts at drilling the borehole too fast can lead to abnormal drilling events that can slow the drilling process.

There are many types of problems that can develop during drilling such as whirl and stick-slip. Stick-slip relates to the binding and release of the drill string while drilling and results in torsional oscillation of the drill string. Stick-slip can lead to damage to the drill bit and, in some cases, to failure of the drill string.

Mathematical models of the drilling system can be created. These models can be used to predict how changes in operating parameters/conditions (e.g., drilling speed, weight on bit, and the like) will affect the drilling process. In some cases, the models can be used by a model-based control system. It is understood that the models may need to be adapted as the system changes. For example, the drill string may experience changes in its physical properties, the bit may become dull, the properties of the drilling mud may change and the like. As such, model-based control systems perform better when constantly updated with actual conditions experienced while drilling. Actual conditions (measurements while drilling) are measured by tools in BHA (bottom hole assembly). The measurements can contain drillstring/BHA dynamics measurements.

One way to transfer actual conditions from a downhole location to the surface is to utilize mud-pulse telemetry. Mud-pulse telemetry is a common method of data transmission used by measurement while drilling tools. Such tools typically include a valve operated to restrict the flow of the drilling mud (slurry) according to the digital information to be transmitted. This creates pressure fluctuations representing the information. The pressure fluctuations propagate within the drilling fluid towards the surface where they are received by pressure sensors. Another way to transfer information may be to utilize an electromagnetic (EM) telemetry system.

In some cases, however, the bandwidth of EM and mud-pulse telemetry systems may not be sufficient to provide all of the data required by the models in a timely manner. In some cases a wired pipe is utilized instead as a telemetry system. Wired pipes provide much greater bandwidth than mud-pulse telemetry systems but are expensive and less reliable.

SUMMARY

According to one embodiment system that includes a control unit including a model of the system that includes model parameters and operational conditions is disclosed. The system of this embodiment also includes an assembly having one or more sensor modules and a second processor that includes definitions of the model parameters that is configured to determine the model parameters based on information received from the one or more sensors. The system also includes a communication medium communicatively coupling the control unit and the assembly.

According to another embodiment, a bottom hole assembly that includes one or more sensor modules and a processor that includes including definitions of the model parameters that is configured to determine model parameters based on information received from the one or more sensors is disclosed. The bottom hole assembly also includes a communication apparatus configured to transmit the model parameters to a control unit at a surface location.

According to another embodiment, method of modeling a parameter of a system in real time is disclosed. The method of this embodiment includes: forming a model of the system, the model including model parameters and operating conditions; providing definitions of the model parameters to a processor located in a bottom hole assembly; receiving, at the processor, measured values from sensor modules in the bottom hole assembly; calculating the model parameters in the processor; and transmitting the model parameters to a control unit; and utilizing them on surface to optimize drilling.

According to another embodiment a system that includes a control unit including a plurality of models of the system that include model parameters is disclosed. The system also includes an assembly that includes one or more sensor modules and a second processor. The second processor includes definitions of the plurality of models and is configured to determine which one of the plurality of models most closely matches information received from the one or more sensors. The system also includes a communication medium communicatively coupling the control unit and the assembly. In this embodiment, the assembly transmits an identification of the one of the plurality of models to the control unit through the communication medium.

BRIEF DESCRIPTION OF THE DRAWINGS

Referring now to the drawings wherein like elements are numbered alike in the several Figures.

DETAILED DESCRIPTION

Disclosed are techniques for allowing the use of a low bandwidth telemetry system (such as a mudpulse or EM telemetry system) in an environment where the bandwidth limitations of such a telemetry system would normally preclude its usage. The techniques, which include systems and methods, include transforming the information that would normally be sent by the telemetry system into another format before sending it.

In one embodiment, the techniques disclosed are utilized to provide real-time measured values in the bottom hole assembly of a drill string to a surface control unit that includes a model of a drill string. Rather than transmitting every measured value to the control unit, the measured values are provided to a processor in the bottom hole assembly. The processor solves for parameters of the model and then only needs to transmit these parameters, rather than the information from a variety of sensors. In one embodiment, the model is used to simulate downhole vibration intensity.

Figure 1:
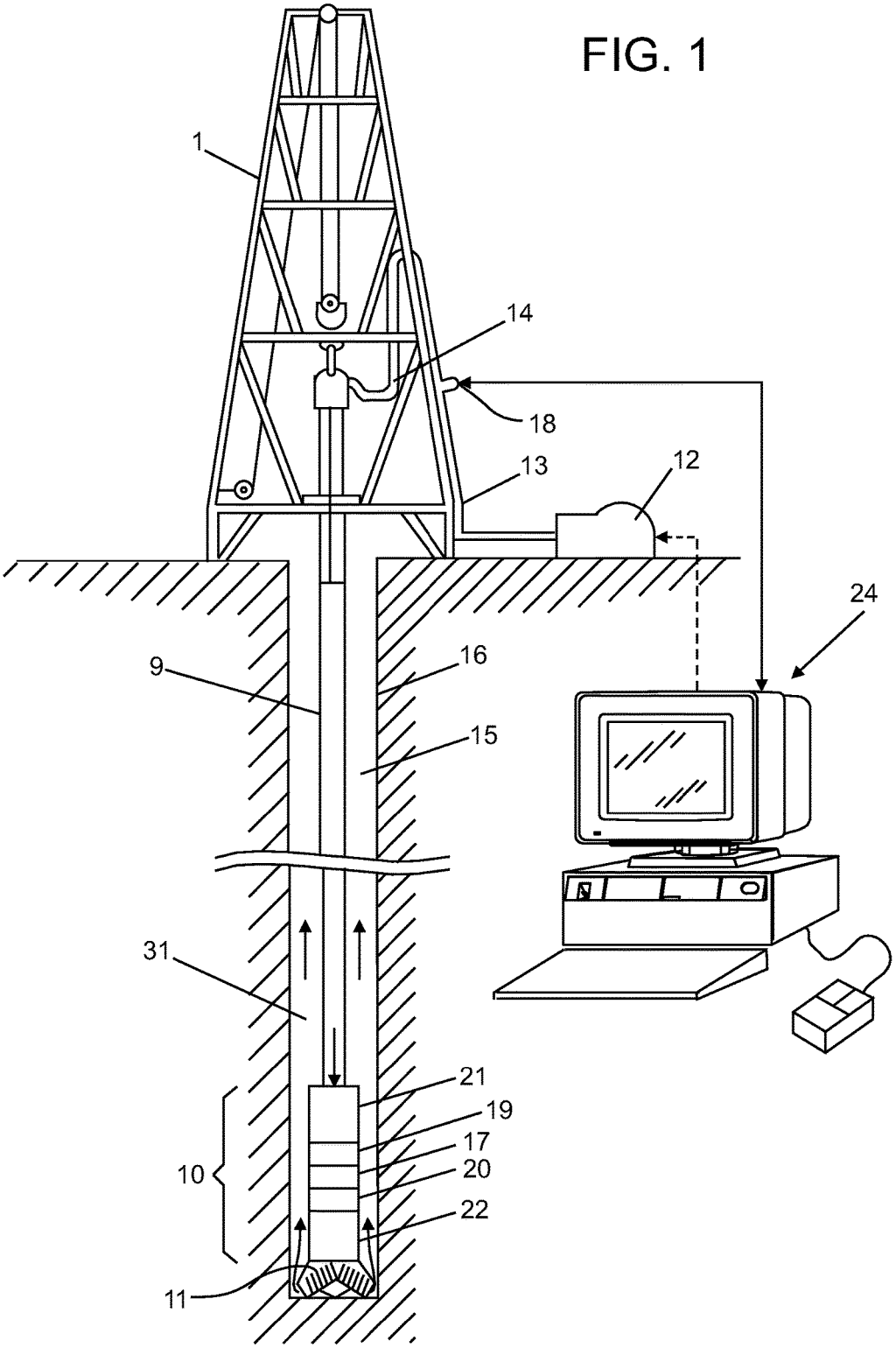
FIG. 1 is a schematic diagram showing a drilling rig engaged in drilling operations.

FIG. 1 is a schematic diagram showing a drilling rig 1 engaged in drilling operations. Drilling fluid 31, also called drilling mud, is circulated by pump 12 through the drill string 9 down through the bottom hole assembly (BHA) 10, through the drill bit 11 and back to the surface through the annulus 15 between the drill string 9 and the borehole wall 16. The BHA 10 may comprise any of a number of sensor modules 17, 20, 22 which may include formation evaluation sensors and directional sensors. The sensor modules 17, 20, 22 and can measure information about any of, for example, the tension or stain experienced by the drill string, temperature, pressure, and the like.

While not illustrated, it shall be understood that the drilling rig 1 can include a drill string motivator coupled to the drill string 9 that causes the drill string 9 to bore in into the earth. The term "drill string motivator" relates to an apparatus or system that is used to operate the drill string 9. Non-limiting examples of a drill string motivator include a "lift system" for supporting the drill string 9, a "rotary device" for rotating the drill string 9, a "mud pump" for pumping drilling mud through the drill string 9, an "active vibration control device" for limiting vibration of the drill string 9, and a "flow diverter device" for diverting a flow of mud internal to the drill string 9. The term "weight on bit" relates to the force imposed on the BHA 10. Weight on bit includes a weight of the drill string and an amount of force caused by the flow of mud impacting the BHA 10.

The BHA 10 also contains a communication device 19 that can induce pressure fluctuations in the drilling fluid 31 or introduce electromagnetic pulses into the drill string 9. The pressure fluctuations, or pulses, propagate to the surface through the drilling fluid 31 or the drill string 9, respectively and are detected at the surface by a sensor 18 and conveyed to a control unit 24. The sensor 18 is connected to the flow line 13 and may be a pressure transducer, or alternatively, may be a flow transducer.

In one embodiment, the control unit 24 may include programming or other means of storing models of physical characteristics of the drill string 9. For example, in one embodiment, the control unit 24 includes one or more models that model torsional oscillations in the drill string 9. Such information can be utilized, for example, to estimate if a stick-slip condition may occur.

In one embodiment, the models may take the simplified form illustrated by Equation 1:

$$F(x,y,z,A,B)=0 \quad (1)$$

where z is physical characteristic being modeled. In one embodiment, z represents the intensity of downhole vibrations of the drill string 9. The variables x and y represent operating conditions that can be controlled at the surface. In one embodiment, the operating conditions are drilling parameters. Examples of drilling parameters can include, for example, weight on bit, rotational speed of the drill string 9, torque imposed on the drill string 9, flow rate of mud from the mud pump 12, operation of the active vibration control devices (not shown) or any other drilling parameter that can be controlled at the surface.

The model shown in Equation 1 can be utilized to model the effects changing operating conditions can have on the drilling system in general and a drill string in particular. Indeed, the model shown in Equation 1 can be used to determine if a certain combination of drilling parameters will cause the drill string 9 to experience an unfavorable situation. For example, the value of z may be used as a predictor of a stick-slip condition. In one embodiment, the model can be used to predict the intensity of torsional oscillations and determine optimal drilling parameter values. Further, in one embodiment, based on the models the control unit 24 can provide quantitative recommendations on changing drilling parameters to mitigate stick-slip or other conditions and can be used in an automated mode by directly connecting to a control system (not shown) of the rig 1 to the control unit 24 to allow the control unit 24 to adjust drilling parameters.

In the context of Equation 1, the values of A and B are constants. As will be understood by one of skill in the art these "constants" are subject to change based on operating conditions and the physical condition of the drill string 9. As such, the values of A and B depend, at least on part, on the values received from sensors modules 17, 20, 22. Accordingly, the "constants" A and B are actually functions that depend on the information from multiple sensors 17, 20, 22. To this end, A and B can be referred to as model parameters in one embodiment. Stated in mathematical terms:

$$F(A,B,m,\ldots,n)=0 \quad (2);$$

where m, . . . , n represents the values received from any number of sensor modules 12, 20, 22.

In the prior art, in order to update the model, the communication device 19 received data from the sensor modules 17, 20, 22 and incapable of providing that information to the control unit 24 fast enough to effectively determine the model parameters. As such, the speed at which models could be updated is limited by bandwidth of the telemetry system.

According an embodiment of the present invention, the BHA 10 includes a processor 21. The processor is configured to include processes that allow it to calculate the values of A and/or B from information it receives from sensor modules 17, 20, 22. Then, rather than transmitting the information received from the sensor modules 17, 20, 22, the communication device 19 need only send the calculated values of A and B. Of course, A and B are presented as examples only and the number of model parameters depends on the particular model utilized.

In another embodiment, the processor 21 could include a plurality of models stored within it. In this embodiment, the processor 21 may compare the models to actual conditions as received from the sensor modules 17, 20, 22. From this, the processor can select the model that most closely represents current conditions. In such an embodiment, only an identification of the model needs to be transmitted by the pulser 19. Of course, in some cases, both an identification of the model and the model parameters can both be transmitted.

Figure 2:
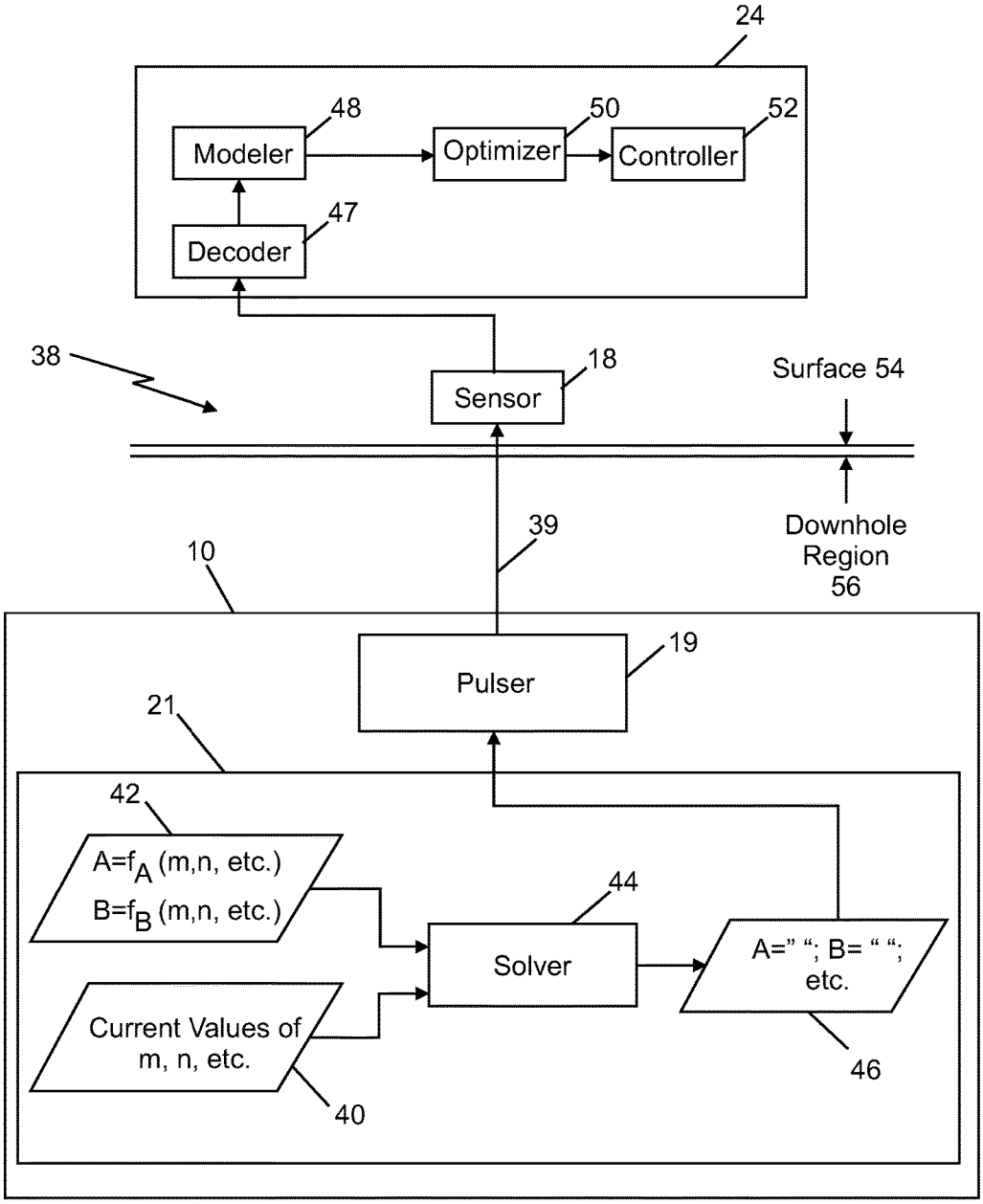
FIG. 2 is a block diagram showing a system according to one embodiment.

FIG. 2 shows a block diagram of a system 38 according to one embodiment. While the system shown in FIG. 2 includes multiple elements, it shall be understood that the system 38 can include less than all of the elements shown in FIG. 2 in some embodiments.

The system 38 includes a bottom hole assembly 10. In one embodiment, the bottom hole assembly (BHA) 10 is communicatively coupled to the control unit 24 by communication medium 39. The communication medium 39 allows for, at least, communication from the BHA 10 to the control unit 24. Of course, the communication medium 39 can allow for bidirectional communication in one embodiment. For ease of explanation, however, only communication from the BHA 10 to the control unit 24 is illustrated in FIG. 2.

In one embodiment, the communication medium 39 is part of a mud-pulse telemetry system. In such an embodiment, the communication medium 39 is drilling mud.

In the event that the communication medium 39 is part of a mud-pulse telemetry system, the system 38 includes additional elements that form the mud-pulse telemetry system. For example, in FIG. 2, the BHA 10 includes a pulser 19 communicatively coupled to sensor 18. The pulser 19, the sensor 18, and the communication medium 39 are operated in accordance with known techniques and such techniques are not discussed further herein.

In FIG. 2, the control unit 24 is shown being at a surface location 54 and the BHA 10 is shown being in a downhole region 56. Of course, the teachings herein could be applied in different contexts.

The BHA 10 in the illustrated embodiment includes processor 21. The processor 21 includes a first data set 40 in one embodiment. The first data set 40 includes current values received from sensor modules 17, 20, 22 (FIG. 1). The processor 21 also includes a second data set 42. The second data 42 set includes definitions of the model parameters, A, B, etc., for a model of the operating system in which the system 38 is implemented. It shall be understood that the first data set 40 and the second data set 42 can be stored in a single or in different storage elements. Further, the first data set 40 and the second data set 42 could be stored in a different processor that is separate from but communicatively coupled to processor 21.

Regardless of how or where stored, the first data set 40 and the second data set 42 are provided to a solver module 44 of the processor 21. The solver module 44 is configured to create a third data set 46 from the first data set 40 and the second data set 42. In particular, the solver 44 utilizes the model parameter definitions defined in the second data set 42 and the current values received from various sensor modules as contained in the first data set 40 to determine values of the model parameters. The model parameters so created form the third data set 46 in one embodiment.

In one embodiment, the third data set 46 is provided to the pulser 19 and transmitted to the control unit 24. In the illustrated embodiment, the signals provided to the drilling mud (communication medium 39) are sensed by sensor 18. The sensed signals are then provided to the control unit 24. In particular, the sensed signals are provided to a decoder 47 that converts the signals to a particular value. For example, the decoder 47 can be configured to remove headers or other identifying information from a series of data packets. Of course, the decoder could be located external to the control unit 24 in one embodiment. For example, the decoder 47 could be located in the sensor 18.

Regardless of where located, the decoder 47 provides the model parameters to modeler module 48 in the control unit 24. The modeler module 48 combines the model parameters with a predetermined model to create a current model. The current model may then, optionally, be provided to an optimizer 50 that optimizes operating conditions of the system the model represents. In addition, the optimized operating conditions can be provided to a controller 52 that varies operation of the system.

Figure 3:
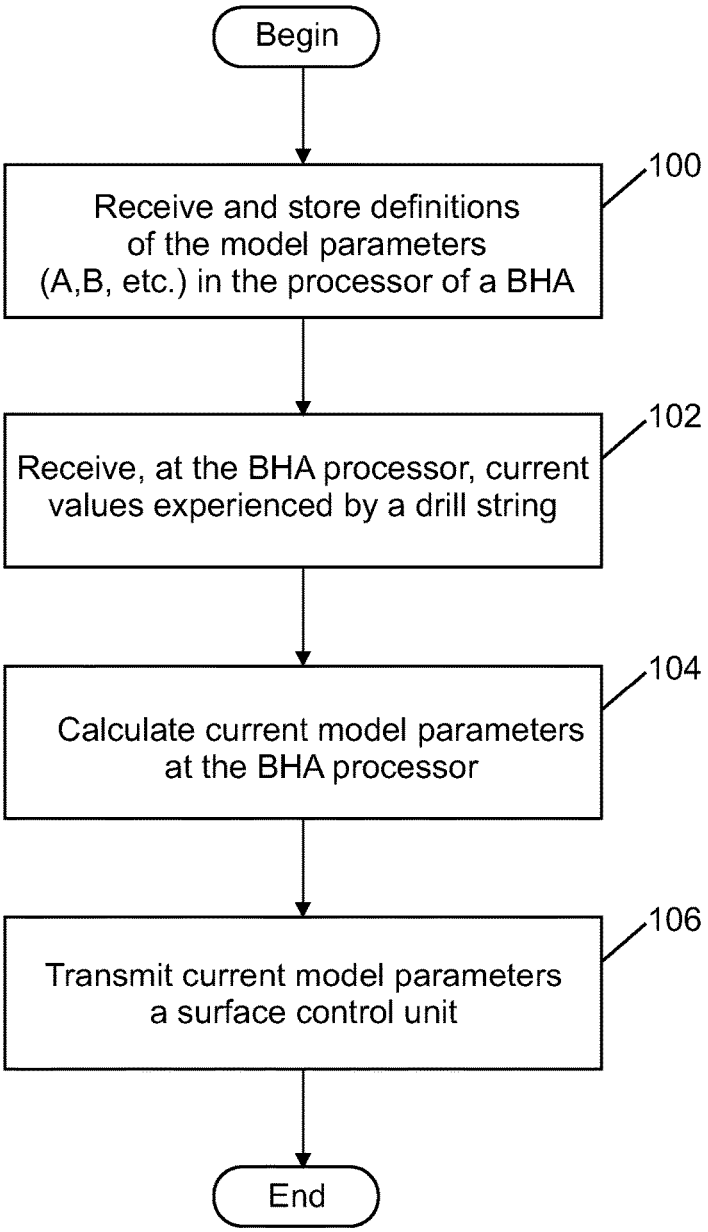
FIG. 3 is flow chart illustrating a method according to one embodiment.

FIG. 3 shows a method according to one embodiment. At block 100 definitions of the model, parameters to be identified (A, B, etc.) and procedure(s) to be used are stored in the processor of a BHA. In one embodiment, the definitions are mathematical functions.

At block 102 current values of forces or other measurable quantities such as temperature and rate of rotation experienced by a drill string are received at the processor of the BHA. These values can include, for example, one or more of: pressure, temperature, and strain experienced by the drill string. The values can be measured, for example, by sensor modules in or near the BHA.

At block 104, current model parameters are calculated at the BHA processor based on the information received in blocks 100 and 102. At block 106, the current model parameters are transmitted to a control unit. In one embodiment, the current model parameters are transmitted over a mud-pulse telemetry system. In another embodiment, the current model parameters are transmitted over an EM telemetry system.

In support of the teachings herein, various analysis components may be used, including digital and/or an analog systems. For example, the controller unit 24 and the processor 21 can include digital or analog systems. The system may have components such as a processor, storage media, memory, input, output, communications link (wired, wireless, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, operator, owner, user or other such personnel, in addition to the functions described in this disclosure.

Further, various other components may be included and called upon for providing for aspects of the teachings herein. For example, a power supply (e.g., at least one of a generator, a remote supply and a battery), vacuum supply, pressure supply, cooling component, heating component, motive force (such as a translational force, propulsional force or a rotational force), magnet, electromagnet, sensor, electrode, transmitter, receiver, transceiver, antenna, controller, optical unit, mechanical unit (such as a shock absorber, vibration absorber, or hydraulic thruster), electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system comprising:

a control unit located at a surface location including a plurality of models of the system that each include model parameters, the plurality of models modeling torsional oscillations in a drill string and used to control operation of the drill string;

a bottom hole assembly located downhole, the assembly including multiple sensor modules and a processor, the processor including definitions of the plurality of models and configured to determine which of the plurality of models most closely matches information received from the multiple sensor modules during a drilling operation; and a communication medium communicatively coupling the control unit and the bottom hole assembly to transfer an identifier of which of the plurality of models most closely matches from the bottom hole assembly to the control unit during the drilling operation;

wherein the control unit further includes a model-based control system configured to control the operation of a drilling rig based on the identifier.

2. The system of claim 1, wherein the communication medium is drilling mud.

3. The system of claim 2, wherein the bottom hole assembly further includes:

a communication device coupled to the communication medium.

4. The system of claim 3, wherein the communication device is a pulser.

5. The system of claim 3, wherein the communication device generates electromagnetic waves and the communication medium is at least partially formed by a drill string.

6. The system of claim 1, wherein the control unit is located at a surface location and the assembly is located in a downhole region.

7. A bottom hole assembly comprising:

multiple sensor modules;

a first processor including definitions of a first model and configured to determine model parameters of the first model that model drilling of a system to which the bottom hole assembly is attached based on information received from the multiple sensor modules during a drilling operation; and a communication apparatus configured to transmit the model parameters to a control unit at a surface location during the drilling operation;

wherein the model parameters are functions of data received from the sensor modules and are used in the first model by the control unit to control the system based on the first model, wherein each model parameter depends on information received from the multiple sensor modules;

wherein the control unit includes a model-based control system configured to control the operation of a drilling rig based on the first model; and wherein the model parameters are determined by setting a function describing the first model to zero and including the information received form the multiple sensor modules in the function.

8. The bottom hole assembly of claim 7, wherein the communication apparatus is a pulser configured to transmit the model parameters through drilling mud.

9. The bottom hole assembly of claim 8, in combination with the control unit.

10. The bottom hole assembly of claim 7, wherein the control unit is located at a surface location and the bottom hole assembly is located in a down hole region.

11. The bottom hole assembly of claim 7, wherein the communication apparatus generates electromagnetic energy and transmits the model parameters through a drill string.

12. A method of modeling a parameter of a system in real time, the method comprising:

forming a first model of the system, the model modeling torsional oscillations of a drill string and including model parameters and operating conditions;

providing definitions of the model parameters to a processor located in a bottom hole assembly;

receiving, at the processor, measured values from multiple sensor modules in the bottom hole assembly during a drilling operation;

calculating the model parameters in the processor during the drilling operation, wherein each model parameter depends on information received from the multiple sensor modules; and transmitting the model parameters to a control unit during the drilling operation; wherein the model parameters are functions of data received from the multiple sensor modules and are used by the control unit in the first model;

wherein the control unit includes a model-based control system configured to control the operation of a drilling rig based on the first model; and wherein the model parameters are calculated by setting a function describing the first model to zero and including the information received from the multiple sensor modules in the function.

13. The method of claim 12, wherein transmitting includes transmitting through a mud-pulse telemetry system.

14. The method of claim 13, wherein the control unit is at a surface location and the bottom hole assembly is located in a downhole region.

* * * * *